US011235918B2

(12) United States Patent
Choplin et al.

(10) Patent No.: US 11,235,918 B2
(45) Date of Patent: Feb. 1, 2022

(54) OPERATION OF A RETRACTION DEVICE OF AN AUTOMATIC BUNDLER

(71) Applicant: SIDEL PACKING SOLUTIONS, Corcelles-les-Citeaux (FR)

(72) Inventors: Gregory Choplin, Corcelles les Citeaux (FR); Grégory Laronche, Corcelles-les-Citeaux (FR)

(73) Assignee: SIDEL PACKING SOLUTIONS, Corcelles-les-Citeaux (FR)

( * ) Notice: Subject to any disclaimer, the term of this patent is extended or adjusted under 35 U.S.C. 154(b) by 220 days.

(21) Appl. No.: 16/114,754

(22) Filed: Aug. 28, 2018

(65) Prior Publication Data

US 2019/0062016 A1 Feb. 28, 2019

(30) Foreign Application Priority Data

Aug. 30, 2017 (FR) ..... 1757974

(51) Int. Cl.
*B65D 71/08* (2006.01)
*B65B 53/06* (2006.01)
*B65B 57/00* (2006.01)

(52) U.S. Cl.
CPC ..... *B65D 71/08* (2013.01); *B65B 53/063* (2013.01); *B65B 57/00* (2013.01)

(58) Field of Classification Search
CPC ..... B65B 53/063; B65B 57/00; B65B 57/16; B65B 57/08; B65B 57/14; B65B 57/04;
(Continued)

(56) References Cited

U.S. PATENT DOCUMENTS 4,597,247 A * 7/1986 Johnson ..... B65B 53/063 53/557
5,062,217 A * 11/1991 Tolson ..... B65B 53/063 34/216

(Continued)

FOREIGN PATENT DOCUMENTS

EP 2 687 447 A1 1/2014
EP 2687447 † 1/2014

(Continued)

OTHER PUBLICATIONS

FR Search Report, dated Mar. 15, 2018, from corresponding FR 1 757 974 application.

*Primary Examiner* — Valentin Neacsu

(57) ABSTRACT

Disclosed is object a method for operating a retraction device of an automatic bundler that is designed to be used in a facility for processing products that are delivered in the form of bundles that each group multiple products held together with a retractable film; with the retraction device being equipped with a retraction furnace including at least one heating unit that is designed to heat the air of the furnace and at least one air circulation unit that is designed to distribute the hot air in the furnace; with the operating method including a production mode during which the bundler is adjusted to be able to produce output and a superficial standby mode that helps save energy. The superficial standby mode includes the reduction in speed of at least one air circulation unit, compared to production mode, to a non-zero value. Also disclosed is a corresponding device.

17 Claims, 2 Drawing Sheets

(58) Field of Classification Search
CPC ... B65D 71/08; F27B 9/40; F27B 9/10; F27D 2019/0059; F27D 2019/0056; F27D 2019/0078
USPC ..... 53/557, 442
See application file for complete search history.

(56) References Cited

U.S. PATENT DOCUMENTS

| | | | | |
|---|---|---|---|---|
| 5,193,290 | A * | 3/1993 | Tolson | B65B 53/02 34/216 |
| 5,850,723 | A * | 12/1998 | Kallfass | B65B 53/063 53/442 |
| 2004/0083687 | A1 | 5/2004 | Christman et al. | |
| 2004/0168411 | A1* | 9/2004 | Christman | B65B 53/063 53/557 |
| 2004/0231301 | A1* | 11/2004 | VanderTuin | B65B 61/12 53/557 |
| 2013/0000256 | A1* | 1/2013 | Schilling | F27B 9/10 53/442 |
| 2014/0316602 | A1* | 10/2014 | Kawai | G05F 1/66 700/297 |
| 2015/0000093 | A1† | 1/2015 | Napravnik | |
| 2019/0064781 | A1* | 2/2019 | Choplin | G05D 23/1917 |

FOREIGN PATENT DOCUMENTS

| | | |
|---|---|---|
| EP | 2 799 352 A1 | 11/2014 |
| WO | 2011/144231 A1 | 11/2011 |

* cited by examiner
† cited by third party

OPERATION OF A RETRACTION DEVICE OF AN AUTOMATIC BUNDLER

BACKGROUND OF THE INVENTION

Field of the Invention

This invention pertains to the field of the production and packaging of products, more particularly to a retraction device of an automatic bundler. The invention thus has as its object, on the one hand, a method for operating such a retraction device, and, on the other hand, a device implementing this method.

Description of the Related Art

In this field, the products that are processed are of the flask, bottle, jug type, etc., and they undergo a first so-called production phase during which they are completed one at a time, i.e., essentially filled, capped, and labeled.

After this first preparation step leading to a ready-to-use product, a second packaging step is implemented for the purpose of obtaining, at the outlet, batches of multiple products, grouped into a rectangular matrix, with or without staggering, and held together with a covering of the plastic film type, with or without a bottom part in the form of a tray or plate, in particular made of cardboard, for example. At the outlet of this second packaging step, the products therefore come in a group within which they are held, like a bundle, for example, with such bundles then in general being placed on pallets for easier shipping.

A bundler is conventionally used to wrap a film around these products that are organized into a matrix and then to retract it under the action of heat, using a retraction device, in such a way as to ensure the holding-together of the various products of the same matrix. In a general manner, the bundlers that are used for the products that are processed in this invention are bundlers that make it possible to operate at a high speed, i.e., bundlers that do not require an operator in normal operation, in other words, automatic bundlers.

For several years, for reasons both economic and environmental, a constant objective has been to limit energy consumption within product production and packaging lines as mentioned above. A more particular effort is provided with regard to the consumption of the retraction device of the bundler to the extent that it may be one of the most energy-intensive elements of a line. This effort pertains more specifically to the establishment of a standby mode making it possible to reduce energy consumption when the bundler is not producing output, for example because of a malfunction of a machine upstream or downstream on the line, or in the event of jamming or dropping of a product.

By way of example, the application WO 2011/144231 proposes the installation of a closing device at the intake and the outlet of the furnace of the retraction device of an automatic bundler. These devices are activated when the bundler is not in the production phase, for the purpose of limiting heat loss on the outside of the furnace.

However, it has been shown that the influence of this type of device was slight on the energy consumption of a retraction device.

Thus, there is a need to improve on the existing approach by using a method that makes it possible to save energy significantly during bundler down times. Preferably, such a method should not impact the operation of the production and packaging line. In other words, the bundler should preferably be ready to restart production as soon as the products will again be available to be processed by the bundler and/or as soon as the conveyor that is placed downstream from the bundler will again be ready to receive bundles.

SUMMARY OF THE INVENTION

The purpose of the invention is thus to propose a solution in which the retraction device can operate in a standby mode when the bundler cannot produce output, in such a way as to bring about a consequent energy savings while allowing the bundler to resume production as soon as the event that led to its stopping no longer has an impact on the capacity of the bundler to process products.

To do this, the invention proposes acting in particular on the mixing of hot air in the furnace of the retraction device. Actually, the retraction device comprises a furnace in which the hot air is mixed using at least one air circulation unit (in general represented by a turbine) to distribute it in such a way as to ensure that a good-quality bundle is obtained. This invention is based on the operation of turbines at a reduced speed when the bundler is not used, compared to speed that is applied when the bundler is operating.

The invention thus has as its object a method for operating a retraction device of an automatic bundler that is designed to be used in a facility for processing products that are delivered in the form of bundles that each group multiple products held together with a retractable film, with said retraction device being equipped with a retraction furnace comprising at least one heating unit that is designed to heat the air of the furnace and at least one air circulation unit that is designed to distribute the hot air in the furnace; with said operating method comprising a production mode during which the bundler is adjusted to be able to produce output and a superficial standby mode that helps save energy.

This method is characterized in that the superficial standby mode comprises the reduction in speed of at least one air circulation unit, compared to production mode, to a non-zero value.

The invention also has as its object a device that implements this method, namely a device for retraction of an automatic bundler that is designed to be used in a facility for processing products that are delivered in the form of bundles that each group multiple products held together with a retractable film; with said device being configured to operate at least according to a production mode during which the bundler is adjusted to be able to produce output or a superficial standby mode that helps save energy, with said device comprising at least:

- A retraction furnace comprising at least one heating unit that is designed to heat the air of the furnace and at least one air circulation unit that is designed to distribute the hot air in the furnace; and
- A control unit that is configured to receive at least one signal for entering into superficial standby mode or for returning to production mode and engaging the mode that corresponds to the signal that is received;

with said device being configured so that during the superficial standby mode, the speed of at least one air circulation unit is reduced, compared to production mode, to a non-zero value.

BRIEF DESCRIPTION OF THE DRAWINGS

The invention will be better understood owing to the description below, which is based on possible embodiments, explained in a way that is illustrative and in no way limiting, with reference to the accompanying figures, in which.

DESCRIPTION OF THE PREFERRED EMBODIMENTS

Figure 1:
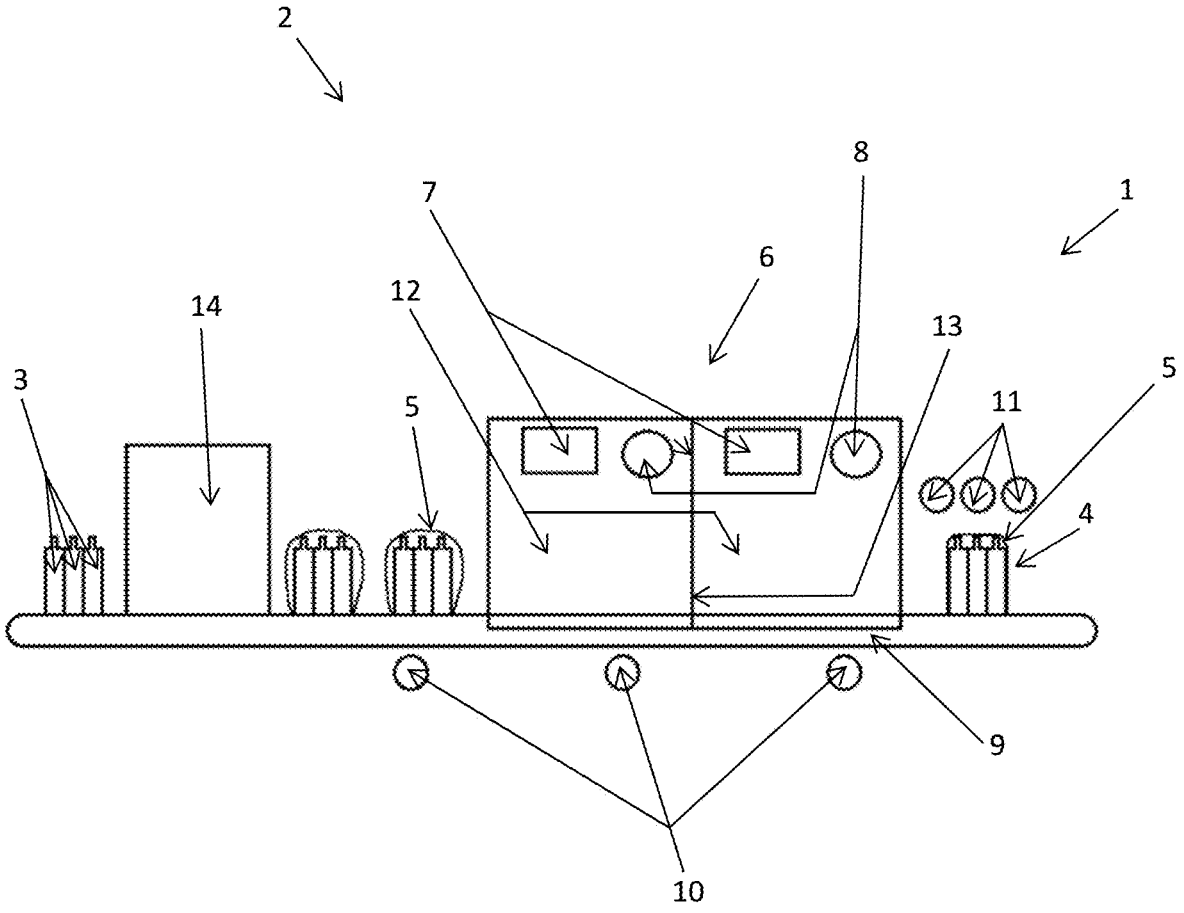
FIG. 1 diagrammatically illustrates an automatic bundler that can operate according to the operating method of the invention, and FIG. 2 diagrammatically shows the management of the various operating modes of a retraction device.

The invention therefore first of all has as its object a method for operating a retraction device 1 of an automatic bundler 2 that is designed to be used in a facility for processing products 3 that are delivered in the form of bundles 4 that each group multiple products 3 held together with a retractable film 5.

In a general manner, the products 3 are of the bottle, flask, jug, can, or other type. The method according to the invention relates to the operation of a retraction device 1 of an automatic bundler 2 that takes place on the products 3.

In a general manner, in a facility for processing products 3 delivered in the form of bundles 4, upstream from the bundler 2, the products 3 are completed one by one through filling, capping and optionally labeling steps. They can also be manufactured, in particular from a preform. Other steps can be provided within a production line, such as, for example, a washing step, a sterilization step, for example, or else a crimping step, in particular when the products 3 are cans.

Just before the bundling performed by the bundler 2, the products 3 are grouped in batches of multiple products that in principle are in contact with one another in matrix form with or without staggering. Usually, products 3 extend along the two edges of the matrix. At this stage, they are in general placed vertically, i.e., with their largest dimensions extending in the vertical direction and with their openings toward the top or toward the bottom.

The bundler 2 then has the role of wrapping the batches of products 3 with a heat-shrinkable film 5 and then in tightening the film using a retraction device 1, so as to keep the products 3 of the same batch together.

There are multiple types of bundlers, namely manual, semi-automatic and automatic bundlers. This invention focuses only on the automatic bundlers 2, which are the only ones that can ensure a high enough rate to meet the requirements of the production of the type of products covered by this invention.

In terms of this invention, "automatic bundlers" are defined as the bundlers that do not require human intervention in the production phase, other than to carry out maintenance operations, to resolve a problem or optionally to feed the bundler with products (this latter case involves only certain models of bundlers). Thus, the bundlers in which the wrapping of the film around the batch or else the production of a seam of the film before the retraction step is carried out manually are not considered to be like the automatic bundlers in terms of this invention. Preferably, this invention focuses on the automatic bundlers whose supply is also automatic, i.e., it does not require human intervention. The automatic bundlers, in terms of this invention, therefore in general have increased autonomy and a minimum operating cost, in comparison to the other bundlers.

Certain bundlers comprise a seam unit that is designed to seal the film that is wrapped around batches before the retraction of the film within a retraction device. Preferably, the automatic bundlers 2 that are suitable for this invention lack such a seam unit.

Downstream from an automatic bundler 2, a facility for processing products can comprise a palletizing device. Such a machine is designed to deposit the bundles that are delivered by the bundler 2 onto a palette, so as to facilitate their transport.

The retraction device 1 according to the invention is equipped with a retraction furnace 6 comprising:

At least one heating unit 7 that is designed to heat the air of the furnace 6, and At least one air circulation unit 8 designed to distribute the hot air into the furnace 6.

The retraction furnace 6, also called a tunnel or else a retraction tunnel, is the element that makes it possible to provide the heat that is necessary for tightening the film that is placed around a batch of products 3. In principle, the air circulation unit(s) 8 of the furnace 6 is (are) represented by (a) turbine(s) but can be represented by any other unit that can mix air within the furnace 6. In the text below, the terms "turbine" and "air circulation unit" will be used interchangeably to refer to an air circulation unit 8 without thereby limiting the scope of the application to a specific unit that can distribute air in the furnace 6.

In a general manner, a retraction tunnel 6 consists of one to five modules 12 that are placed following one another and separated by a wall 13 between each module. Each module in general comprises a heating unit 7, also called a heating block, connected to a turbine 8. Each module 12 then operates independently, which makes it possible to adjust the conditions within the tunnel to optimize the shaping of the bundle. In the text below, the terms "heating unit 7" or the equivalent as well as "turbine 8" or the equivalent will appear interchangeably in the singular or in the plural, without thereby limiting this invention to furnaces 6 with a single module 12 or with multiple modules 12. These terms are no longer limited to furnaces with a single heating unit 7 or with multiple heating units 7 nor to furnaces with a single turbine 8 or with multiple turbines 8.

The heating unit 7 is preferably represented by a gas burner or by electric resistors. It is designed to provide the amount of heat that is necessary so that the furnace 6 reaches its setpoint temperature by heating the air of the furnace 6. Thus, the heating unit 7 operates at a given power that is adjusted based on the setpoint temperature, corresponding to the temperature that the air of the furnace should reach.

The air circulation unit 8 (or turbine 8) is then used to distribute the air that is heated by the heating block 7 in the furnace 6 so as to obtain a flow of hot air in such a way as to form a good-quality bundle, i.e., with the fewest folds possible and making possible a good hold of a batch of products 3.

So as to optimize the energy consumption, the operating method of this invention comprises a production mode during which the bundler 2 is adjusted to be able to produce output and a superficial standby mode that helps save energy. In particular, in production mode, the bundler is adjusted to be able to produce output normally, in terms of speed and amount.

When the operating method according to the invention is in production mode, the retraction device 1 is adjusted so that a retractable film placed around a batch of products 3 that travels in this device 1 tightens in an optimal manner to form a bundle 4. Traditionally, this operating mode is the one that is used at any time in a production phase, including when there is a malfunction on the line, preventing the bundler 2 from operating. Within the framework of this invention, this mode is preferably used only when the bundler 2 produces output, i.e., when it delivers bundles 4.

The superficial standby mode corresponds to an economical mode that has as its object to limit the energy consumption of the retraction device 1 when the bundler 2 cannot produce output. When the operating method is in the superficial standby mode, certain adjustments are modified compared to production mode, in such a way as to optimize the energy consumption in particular by reducing the expenditure and/or by preserving as much as possible the heat of the furnace 6 for the purpose of returning to production mode. Thus, the adjustments that are made to the retraction device in the superficial standby mode are such that they do not make possible the shaping of a shrink-wrap of satisfactory quality and even do not make possible the shaping of a shrink-wrap.

The superficial standby mode is therefore used when the bundler 2 cannot produce output, for example due to the absence of products 3 in particular because of a malfunction having taken place on the production line. Such a malfunction can be at the bundler 2 as well as upstream or downstream from this machine. Another reason preventing the bundler 2 from producing output can be a product 3 that falls, a jamming of product 3, a maintenance operation, or else when the operator decides to interrupt production temporarily.

The management of the switching from production mode to superficial standby mode and vice versa can be administered by a control unit 15 that belongs to the retraction device 1. Such a unit 15 receives a signal that comes either from an operator or directly from an element of the production line and engages the mode corresponding to the signal.

The operating method according to the invention is characterized in that the superficial standby mode comprises the reduction in speed of at least one air circulation unit 8, compared to production mode, to a non-zero value.

The reduction in speed of an air circulation unit 8 corresponds to the reduction in its rotating speed, in other words its rotating frequency. In a general manner, the reduction in speed of a turbine 8 corresponds to the reduction in its operating power. This reduction in speed produces a slower circulation of air within the retraction device 1 and therefore a flow and a mixing of the air that are lower than in production mode. Preferably, the speed of all of the turbines 8 of the retraction device 1 that is used in the invention is reduced, compared to production mode, to a non-zero value.

In production mode, the turbines 8 of the furnace 6 operate at a given speed, adjusted to make possible an optimum mixing of air for the purpose of the shaping of bundles 4. The inventors noted that when the bundler 2 is stopped, it is not necessary to mix the air as intensely as when the bundler 2 produces output since bundles 4 are not shaped. The fact of slowing down the operating speed of a turbine 8 advantageously makes it possible to realize a significant energy savings. In addition, the fact that the turbine 8 is slowed down, but not stopped, advantageously makes it possible to cool the heating block 7 and therefore to limit considerably the risk of deterioration of the heating unit 7. In addition, a minimum mixing of air within the retraction furnace 6 and therefore a limitation of the heat loss outside of the furnace 6 advantageously result from this.

According to a possible additional characteristic of the operating method, during the superficial standby mode, the speed of at least one air circulation unit 8, and even all of the air circulation units 8, is reduced to a value that ranges from 10 to 90%, preferably 30 to 80%, in particular 50 to 70%, of the speed in production mode.

When the furnace 6 comprises multiple turbines 8, the speed of each turbine 8 can be reduced in a different proportion. For example, the speed of the turbine 8 of a given module can be reduced by 20%, whereas the speed of the turbine of another module can be reduced by 50%. Preferably, the speed of all of the turbines 8 of the furnace 6 is reduced in an essentially equivalent proportion.

In a general manner, the operating speed of a turbine 8 in production mode goes from 800 to 2,500 rpm. In the superficial standby mode, it preferably goes from 500 to 1,000 rpm.

According to a possible additional characteristic of the operating method, the superficial standby mode also comprises the lowering of the setpoint temperature of the furnace 6 from a predefined value, compared to production mode, to a so-called setpoint value in standby mode.

The setpoint temperature of the furnace 6 corresponds to the target temperature of the furnace. The temperature of the furnace 6 corresponds to the temperature of the air that circulates therein. It is therefore understood that the setpoint temperature can be different according to the mode in which the retraction device 1 operates. It is also understood that the temperature of the furnace 6 does not necessarily correspond to the setpoint temperature. The temperature of the furnace 6 is generally measured throughout the method according to the invention, in principle with a thermocouple. During the production mode, the furnace is therefore generally at its setpoint temperature in production mode, which is approximately 200° C. When the furnace 6 has multiple modules, the setpoint temperature, and therefore the measured temperature, can slightly vary from one module to the next for reasons of optimization of the conditions for obtaining a bundle of better quality. In superficial standby mode, the setpoint temperature of the furnace 6 can therefore be lowered by a predefined value, which means that if the furnace 6 has multiple modules, the setpoint temperature can be lowered by a predefined value in each module. When the setpoint temperature is lowered, the heating unit(s) is (are) controlled, in particular turned off, to make it possible for the furnace to reach the setpoint temperature of the superficial standby mode.

When the superficial standby mode comprises the lowering of the setpoint temperature of the furnace 6 by a predefined value, the energy savings that is realized proves advantageous for several reasons. First, a reduction in the setpoint temperature of the furnace 6 drives the reduction, and even the stopping, of the energy consumption of the heating unit(s) 7. Furthermore, because the turbine 8 also operates at reduced speed, the mixing of the air is less within the furnace 6, which makes it possible for the temperature of the furnace to decrease more slowly than if the turbine 8 were operating in normal mode. The result is a better preservation of heat for the purpose of a return to normal operating mode.

The heating units are generally turned off so that the temperature decreases, but they are not necessarily turned off for the entire duration of the standby mode of the operating method. Actually, when the setpoint temperature in standby mode is reached, it may be that the furnace 6 should preserve its setpoint temperature in standby mode. The heating units 7 are therefore turned on again, but in general at a lower power than that which is applied in production mode since the setpoint temperature is lower. Thus, the power of the heating units 7 of the furnace 6 can vary during the same superficial standby period in such a way that the temperature of the furnace 6 does not decrease beyond the temperature variation allowed by the setpoint.

When the heating units 7 of the furnace 6 are electric resistors, their power can be changed in particular using a dimmer that makes it possible to modulate the heating power, keeping the resistors turned on only a part of the time that is determined based on the desired heating power. By way of example, the resistors can be turned on each second for 4/10 of a second and turned off for 6/10 of a second. By contrast, if the heating units 7 are gas burners, it is possible to modulate the power of the burners directly to make the heating power vary.

Preferably, the lowering of the setpoint temperature of the furnace 6 is performed essentially simultaneously to the reduction in speed of at least one air circulation unit 8. In general, the lowering of the setpoint temperature of the furnace 6 and of the speed of at least one air circulation unit 8 is performed when the standby mode is engaged. However, these two actions can be carried out at different times; in particular, the lowering of the setpoint temperature of the furnace 6 may have taken place subsequently to the reduction in speed of at least one turbine 8.

According to a possible additional characteristic of the operating method, the superficial standby mode comprises the lowering of the setpoint temperature of the furnace 6 only if the minimum stopping period of the bundler 2 is known.

Minimum stopping period of the bundler is defined as the minimum period during which the bundler cannot produce output, because it does not receive products 3 that are ready to be bundled or because it is undergoing maintenance or has experienced a malfunction. Thus, the superficial standby mode can comprise the reduction of the setpoint temperature of the furnace 6, which is done only if it is possible to estimate a minimum length of time before which products will again be ready to be processed by the bundler.

By way of example, such a period can be known when an operator decides to stop the production during a determined period. Such a period can also be known if there is a malfunction or a problem in any area of the production and packaging line, and it is possible to evaluate a minimum processing period. Yet another possibility is that a malfunction involves an upstream element and that the necessary period (of x minutes) so that the products 3 travel from this upstream element to the inlet of the bundler is known. In this latter case, even if the necessary period for correcting the malfunction is not known, it is known that the products 3 will be ready to be processed again by the bundler x minutes after the resolution of the malfunction.

Since it takes a furnace a certain length of time to rise and fall in temperature, the superficial standby mode of the method of the invention preferably comprises the lowering of the setpoint temperature if a minimum stopping period of the bundler 2 is known. As presented in detail subsequently, the fact that it is necessary to know a minimum stopping period of the bundler 2 to lower the setpoint temperature of the furnace 6 makes it possible to adapt the lowering value based on this period in such a way that the furnace 6 can again reach its production temperature the earliest possible after the bundler should resume production, preferably at the latest when the bundler 2 should again process the products 3, i.e., at the time when the products 3 are again ready to be processed by the bundler 2 and/or at the time when the elements that are placed downstream from the bundler 2 can again receive bundles 4. In other words, the lowering value is preferably determined in such a way that the temperature of the furnace 6 is not the element that prevents the resumption of production. Actually, when the event that has caused the bundler 2 to stop has ended and when the products 3 are ready to be bundled and/or bundles 4 are ready to be received downstream from the bundler, it is preferable that the furnace 6 be at its setpoint temperature in production mode.

Thus, the operating method advantageously makes it possible to reduce energy consumption while having a slight impact—and even zero impact—on the production of the entire production and packaging line of products 3.

According to a possible additional characteristic of the operating method, the retraction device 1 also comprises:

- A transport unit 9 on which the products 3 rest and which travels through the furnace 6,
- At least one first cooling unit 10 that is designed to cool the transport unit 9 during its return trip, and
- At least one second cooling unit 11 that is designed to cool the bundles 4 at the outlet of the retraction furnace 6;
- with the superficial standby mode also comprising turning off at least one first cooling unit 10 and/or at least one second cooling unit 11.

The transport unit 9 that is used in this invention is in general a conveyor belt. Such an element has two drums located at the upstream and downstream ends of the belt. The belt therefore travels in the furnace by carrying batches of products 3. After exiting from the furnace 6, it deposits bundles on another surface, and then reaches the downstream drum. It then begins its return trip until reaching the upstream drum and then transports new batches of products 3 through the furnace, etc. Each area of the belt of the transport unit 9 therefore regularly travels in the retraction tunnel 6 and stores the heat. It is for this reason that the retraction device 1 that is used in this invention preferably comprises at least one first cooling means 10, which has as its purpose to cool the belt during its return trip, i.e., when it travels between its downstream drum and its upstream drum. This (these) first cooling means 10 is (are) located in general below the belt, more specifically under the lower strip of the belt, i.e., the part of the belt in the return area. In principle, there are one or more fans. In production mode, at least one cooling means 10, preferably all of the cooling means 10, is/are turned on.

In superficial standby mode, at least one first cooling means 10 can be turned off. Preferably, all of the first cooling means 10 are turned off. In certain embodiments, the first cooling means 10 are turned off only temporarily during the superficial standby mode. Thus, if, for example, the belt overheats, in particular when the setpoint temperature of the furnace 6 has not been lowered during the superficial standby mode, it is possible to turn on one or more first cooling means 10 again. The first cooling means 10 can, for example, be automatically turned on again if the belt passes above a certain predefined temperature.

The bundles 4 that exit from the retraction furnace are in general relatively hot at the outlet of the retraction furnace 6, which affects the hold of the products 3 by the retractable film. For this reason, the retraction device 1 that is used in this invention preferably comprises at least one second cooling means 11, which has as its object to cool the bundles 4 just after their exit from the furnace 6. In principle, there are one or more fans, preferably located above the bundles 4 when they exit from the furnace 6. Such fans can also be placed on the sides of the bundles 4 when they exit from the furnace 6. In production mode, at least one cooling means 11, preferably all of the cooling means 11, is/are turned on.

When the bundler does not produce output, the bundles 4 do not exit from the furnace 6, and it is therefore not necessary to cool them. Thus, in superficial standby mode, at least one second cooling means 11 can be turned off. Preferably, all of the second cooling means 11 are turned off.

According to certain preferred embodiments, during the superficial standby mode, all of the first cooling means 10 and second cooling means 11 are turned off.

In some cases, the retraction furnace 6 can comprise doors 18 at its intake and its outlet. According to certain embodiments, the superficial standby mode can then also comprise the closing of these doors 18 so as to reduce heat loss.

According to a possible additional characteristic of the operating method, the reduction in speed of at least one air circulation unit 8 is performed essentially simultaneously to the turning off of at least one first cooling unit 10 and/or at least one second cooling unit 11.

Preferably, when the superficial standby mode is engaged, all of the modifications that are performed for switching from production mode to superficial standby mode are performed essentially simultaneously.

According to a possible additional characteristic of the operating method, during the superficial standby mode, the speed of all of the air circulation units 8 is reduced to a non-zero value, and, if necessary:

- The setpoint temperature of the furnace 6 is lowered by a predefined value compared to production mode, and
- All of the first cooling units 10 and second cooling units 11 are turned off.

Thus, according to a preferred embodiment, the superficial standby mode comprises:

- The reduction in speed of all of the turbines 8 to a non-zero value;
- Turning off all of the first cooling units 10, and
- Turning off all of the second cooling units 11.

This embodiment is more particularly implemented when the minimum stopping period of the bundler is unknown.

According to another preferred embodiment, the superficial standby mode comprises:

- The reduction in speed of all of the turbines 8 to a non-zero value,
- Turning off all of the first cooling units 10,
- Turning off all of the second cooling units 11, and
- Lowering the setpoint temperature of the furnace 6 by a predefined value.

This embodiment is more particularly implemented when the minimum stopping period of the bundler is known.

According to a possible additional characteristic:

- The superficial standby mode comprises the lowering of the setpoint temperature of the furnace 6 as defined above, and
- The operating method also comprises an extended standby mode that comprises stopping all of the air circulation units 8 and optionally the transport unit 9, with said extended standby mode being engaged when, during the superficial standby mode, the temperature of the furnace 6 is lowered until reaching a predefined threshold temperature.

Actually, when the retraction device operates according to the superficial standby mode, the turbines 8 continue to mix the air of the furnace 6, even if they rotate at a reduced speed compared to production mode. This makes it possible to cool the heating blocks 7 to prevent their deterioration. However, when the superficial standby mode also comprises the lowering of the setpoint temperature of the furnace 6 compared to production mode, the heating blocks 7 are in principle turned off to make it possible for the furnace 6 to drop in temperature. Thus, if the setpoint temperature is low enough, at the end of a certain temperature drop time, the heating blocks 7 are cold enough to no longer require being cooled by the air circulation units 8.

Consequently, in certain embodiments, a threshold temperature, lower than the setpoint temperature of the furnace 6 in production mode but higher than the setpoint temperature in standby mode, is set in such a way that the turbines 8 are turned off when the temperature of the furnace 6 reaches this threshold temperature, thus engaging the mode referred to as extended standby mode. The method can therefore comprise switching from production mode to superficial standby mode, and then switching from superficial standby mode to extended standby mode. In contrast, the method preferably does not comprise a direct switching from production mode to extended standby mode because there would be a risk of damaging the heating blocks 7. Preferably, the turbines 8 are turned off automatically when the furnace 6 reaches the threshold temperature.

Typically, the threshold temperature is around 100° C., whereas the operating temperature of the furnace 6 in production mode is on the order of 200° C. Thus, if the setpoint temperature of the furnace in superficial standby mode is less than 100° C., for example 80° C., when the furnace drops in temperature and of around 100° C. when it reaches the threshold temperature, the extended standby mode is engaged, in particular in an automatic manner, thus causing the turbines 8 to stop.

The engagement of the extended standby mode produces additional energy savings because energy is no longer being consumed for the operation of the turbines 8. In addition, with the mixing of air from the furnace 6 being stopped, the furnace continues to drop in temperature but more slowly, which makes it possible to better preserve heat in the furnace for the purpose of a subsequent return to production mode. In other words, for an identical operating period in superficial standby mode and in extended standby mode, the furnace loses more heat in superficial standby mode. Consequently, during the return to production mode, less energy and less time will be necessary to make it possible for the furnace to reach again the operating temperature in production mode if the extended standby mode is engaged.

According to certain embodiments, the extended standby mode of the operating method also comprises the stopping of the transport unit 9 or at least a significant lowering of its speed. Thus, the extended standby mode can cause the turning off of all of the turbines 8 and the interruption of the transport unit 9.

When the retraction device 1 operates in extended standby mode, a return to production mode is preferably carried out by means of switching into superficial standby mode. Actually, before raising the temperature of the furnace 6 and therefore turning on the heating blocks 7, it is preferable to restart the turbines 8 to keep the heating blocks 7 from overheating. Thus, the method can comprise switching from extended standby mode to superficial standby mode, and then switching from superficial standby mode to production mode. In contrast, the method preferably does not comprise switching directly from extended standby mode to production mode.

In a general manner, whether the method comprises an extended standby mode or not, two different setpoint temperatures can be applied to the furnace 6, namely:

- A setpoint temperature in production mode that corresponds essentially to the temperature that the furnace 6 should have for producing output, and A setpoint temperature in standby mode that corresponds to the temperature to which the furnace 6 can drop in superficial standby mode, and, if necessary, in extended standby mode.

In other words, the setpoint temperature that is applied to the furnace 6 in general does not differ depending on whether the retraction device is in superficial standby mode or extended standby mode.

According to a possible additional characteristic of the operating method, the retraction device 1 returns to superficial standby mode from extended standby mode when the furnace 6 reaches the setpoint temperature of the standby mode.

Actually, when the furnace 6 reaches the setpoint temperature in standby mode, it should not continue to drop in temperature. It is therefore necessary to turn on the heating blocks 7 to maintain the temperature of the furnace 6. However, to keep the heating blocks 7 from deteriorating, it is preferable that the air be ventilated in their vicinity. For this reason, the mixing of the air is initiated before the heating blocks 7 are turned on. Still, in a desire to optimize the energy consumption of the retraction device 1, the mixing is indeed restarted but at the intensity that corresponds to that of the superficial standby mode.

Thus, when the method operates according to the extended standby mode and the furnace 6 reaches the setpoint temperature of the standby mode, the turbines 8 are restarted at their operating speed in superficial standby. If the transport unit 9 was also slowed down and even stopped during the extended standby mode, it is set back to its operating speed in production mode, preferably at the same time as the turbines 8, so as to keep it from overheating. The return from the extended standby mode to the superficial standby mode can be engaged, for example, in an automatic manner when the furnace 6 reaches its setpoint temperature in standby mode.

When the superficial standby mode is exited to return to production mode, the bundler 2 can again operate when all of the turbines 8 operate at their production speed, and, if necessary, when:

The furnace 6 has reached its setpoint temperature in production mode,

All of the first cooling units 10 are turned on, and

All of the second cooling units 11 are turned on.

Among these various parameters, bringing the turbines 8 back to their production speed and turning on the first and second cooling means 10, 11 are instantaneous or almost instantaneous. By contrast, the furnace 6 takes a certain amount of time to reach its production temperature again. For this reason, to save more energy, during the return to production mode, the parameters that are modified during the beginning of the superficial standby can be brought back into production mode at different times.

Thus, when the setpoint temperature of the furnace 6 has not been lowered during the superficial standby mode, the parameter(s) modified when entering superficial standby mode are preferably brought back into production mode, essentially simultaneously, in general at the time when products 3 are again ready to be processed by the bundler 2.

By contrast, when the setpoint temperature of the furnace 6 has been lowered during the superficial standby mode, bringing the setpoint temperature of the furnace 6 back to its value in production mode is preferably the first parameter to be brought back into production mode, so as to optimize the energy savings.

Thus, according to a possible additional characteristic of the operating method:

The superficial standby mode comprises the lowering of the setpoint temperature of the furnace 6 as defined above, and The retraction device 1 returns to production mode from superficial standby mode, via at least the following successive steps:

(i) Bringing the setpoint temperature of the furnace 6 back to its value in production mode, (ii) Bringing the speed of all of the air circulation units 8 back to the operating speed thereof in production mode, and, if necessary, restarting the first and/or second cooling units 10, 11, with step (ii) preferably taking place once the furnace 6 has reached its operating temperature in production mode.

In this manner, an energy savings is advantageously realized in the turbines 8, and, if necessary, in the first and second cooling means 10, 11, during which the furnace 6 rises in temperature.

In the cases where the superficial standby mode comprises the closing of doors 18 placed at the intake and the outlet of the furnace 6, step (ii) then in general comprises the reopening of these doors.

According to a possible additional characteristic of the operating method, during the return to production mode from the superficial standby mode, all of the air circulation units 8 are brought back to the operating speed thereof in production mode and, if necessary, all of the first and second cooling units 10, 11 are restarted, with this (these) actions being carried out at the latest when the bundler 2 is to process products 3.

In other words, the turbines 8, and, if necessary, the first and second cooling means 10, 11 are brought back into production mode at the latest when:

The products 3 are again ready to be processed by the bundler 2, i.e., when the products 3 arrive at the bundler 2, and/or The elements that are placed downstream from the bundler 2 can again receive bundles 4, i.e., to absorb the stream of bundles 4 exiting from the bundler 2.

In a more preferred manner, the turbines 8 and the cooling means 10, 11 are brought back into production mode when the bundler 2 is to process the products 3.

Thus, in the case where the setpoint temperature of the furnace 6 is lowered in superficial standby mode, the return to production mode is engaged preferably before the bundler 2 is again ready to operate. In a first step, the setpoint temperature of the furnace 6 is then raised to the production temperature. Preferably, the turbines 8 and, if necessary, the first and second cooling means 10, 11 are then brought back into production mode when the furnace 6 has reached the production temperature, and also preferably when the products 3 are ready to be processed by the bundler 2.

According to a possible additional characteristic of the operating method:

The superficial standby mode comprises the lowering of the setpoint temperature of the furnace 6 whereas the minimum stopping period of the bundler 2 is known as defined above, and During the return to production mode from superficial standby mode, the setpoint temperature of the furnace 6 is brought back to its operating temperature in production mode at the latest at the time making it possible for the furnace 6 to be at this temperature when the bundler 2 is to process products 3.

To do this, it is necessary to know the minimum stopping period of the bundler 2. Actually, in this case, it is possible to anticipate by determining at what time the furnace 6 starts to rise in temperature so that it can reach its production temperature at the latest when products 3 are again ready to be processed by the bundler 2 and/or when the elements that are placed downstream from the bundler 2 can again receive bundles 4. Actually, the speed at which a furnace heats is part of these characteristics. By knowing this characteristic, one skilled in the art can determine at what time to modify the setpoint temperature so that the furnace 6 reaches its production temperature at the latest when the bundler 2 should again process the products 3. Such an operating mode is particularly advantageous to the extent that the standby mode does not generate any impact on the production of the entire line. Actually, the retraction device 1 is in production mode at the latest when products 3 are ready to be bundled and/or when new bundles 4 may be received downstream, owing to an anticipation of bringing the setpoint temperature of the furnace 6 back to its production value.

In a more preferred manner, in particular when the stopping period of the bundler 2 is known, the furnace 6 reaches its setpoint temperature in production mode at the time when the products 3 are again ready to be processed by the bundler 2. In this case, the energy savings reaches its optimum, since the retraction device 1 is in production mode only at the time when it is to produce output.

As indicated above, the value to which the setpoint temperature of the furnace 6 is to be lowered in superficial standby mode can be adapted based on the minimum stopping period of the bundler 2 so that the furnace 6 can again reach its production temperature at the latest when the bundler 2 is again to process the products 3. This value is therefore determined based on the speed at which the furnace 6 falls and rises in temperature, and based on the minimum stopping period of the bundler 2.

The following two illustrative cases can, for example, arise. In the first place, it is possible to have knowledge of an event that prevents the bundler 2 from operating during a certain minimum time, for example 10 minutes. In this case, the setpoint temperature in superficial standby mode will be calculated so that the furnace 6 can drop in temperature until reaching the lowered setpoint and then rise in temperature to reach the production temperature again, upon the expiration of this minimum period. In the second place, it is possible to have knowledge of a necessary minimum period, for example three minutes, so that the products 3 can again reach the bundler 2, once an incident that takes place upstream from the bundler 2 is resolved. In this case, the setpoint temperature in standby mode will be adjusted to a value such that the furnace 6 can pass from the setpoint temperature in standby mode to the production temperature in the period that is necessary so that the products 3 move to the bundler 2 starting from the site of the incident, namely three minutes here. The furnace 6 will therefore be maintained at its setpoint temperature in standby mode until the incident is resolved. At this time only, the setpoint temperature of the furnace 6 will be brought back to its production value.

The invention also has as its object a device that is configured to implement the method as described above.

In particular, there may be a retraction device 1 of an automatic bundler 2 that is designed to be used in a facility for processing products 3 that are delivered in the form of bundles 4 that each group multiple products 3 held together with a retractable film 5; with said device 1 being configured to operate at least according to a production mode during which the bundler 2 is adjusted to be able to produce output or a superficial standby mode that helps save energy, with said device 1 comprising at least:

A retraction furnace 6 that comprises at least one heating unit 7 that is designed to heat the air of the furnace 6 and at least one air circulation unit 8 that is designed to distribute the hot air in the furnace 6; and A control unit 15 that is configured to receive at least one signal for entering into superficial standby mode or for returning to production mode and engaging the mode that corresponds to the signal that is received;

with said device 1 being configured so that during the superficial standby mode, the speed of at least one air circulation unit 8 is reduced, compared to production mode, to a non-zero value.

Thus, the device 1 comprises a control unit 15 that can make said device 1 operate in the desired mode. More specifically, during a change in operating mode of the device 1, it receives a signal, for example for entering into superficial standby mode, and then engages the mode that corresponds to this signal, namely the superficial standby mode. In the same manner, if it receives a signal for returning to production mode, it then engages the return to production mode.

In addition, when the operating method comprises an extended standby mode, the device 1 can also be configured to receive a signal for entering into extended standby mode or for returning to superficial standby mode and engaging the mode that corresponds to the signal that is received. Thus, if it receives a signal for entering into extended standby mode, it engages the extended standby mode, and if it receives a signal for returning to superficial standby mode, it engages the return to superficial standby mode.

Figure 2:
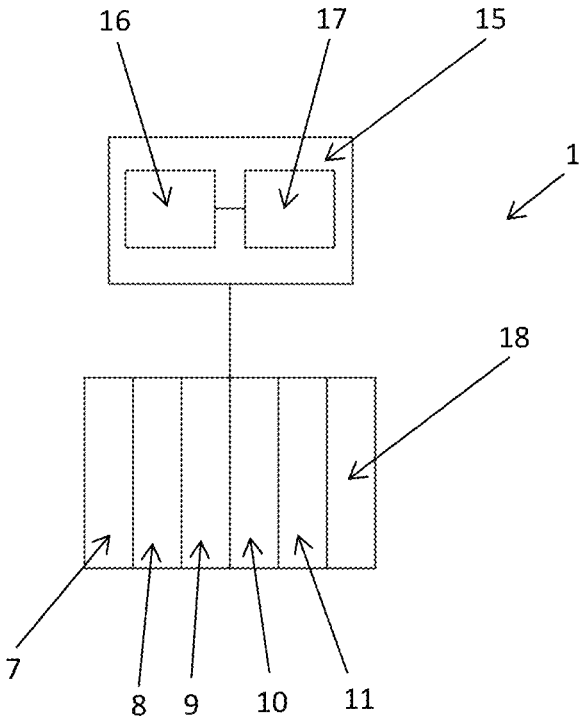

As shown in FIG. 2, such a control unit 15 comprises a memory 16 and a processor 17. The memory 16 can store the instruction code that can be read and executed by the processor 17. The instruction code that is stored in the memory 16 can come in the form of a computer program, which, when it is executed by the processor 17, makes the device 1 operate according to the operating method that is described above.

In the embodiment that is illustrated in the accompanying FIG. 1, an automatic bundler 2 is shown. Groups of products 3 arrive at the intake of the bundler 2 and depart therefrom in the form of self-supported bundles 4. In a first step, the groups of products 3 enter into an area 14, in which they are wrapped by a heat-shrinkable film 5.

The groups of products 3 that are enveloped with a film 5 then reach the retraction device 1 according to this invention. The retraction device 1 of the bundler 2 shown in FIG. 1 comprises at least:

A retraction furnace 6 that is designed to tighten the film 5 that is wrapped around each batch of products 3 because of the heat of the air within this furnace 6. Typically, the temperature is around 200° C.;

A transport unit 9 that can be the same as the one that may or may not transport the products 3 into the area 14. This transport unit 9 is preferably a conveyor belt. It leads the batches of products 3 through the retraction furnace 6, i.e., it begins before the furnace 6 and ends after it;

First cooling units 10 that are designed to cool the belt of the transport unit 9 on its return trip, i.e., its path that goes from the outlet of the furnace 6 toward its intake. These first cooling units 10 make it possible to keep the belt from storing too much heat and are located under the transport unit 9. In general, these are fans. In FIG. 1, these first cooling means number three, but there may very well be only one or two, or else more than three, such as four or five, for example; and Second cooling units 11 that are designed to cool the bundles 4 at the outlet of the furnace 6. These second cooling units 11 make it possible more specifically to cool the film 5 and therefore to ensure a better hold of the products 3 within a bundle 4. They are in general located just above the bundles 4 that exit from the furnace 6. In general, these are fans. In FIG. 1, these second cooling means number three, but there may very well be only one or two, or else more than three, such as four or five, for example.

The retraction furnace 6 shown in FIG. 1 comprises two modules that are separated by a wall 13. However, the devices that comprise furnaces 2 that comprise 1 to 5 modules, and even more, are part of this invention. In the furnace 6 of FIG. 1, each module comprises at least one heating unit 7 that is designed to heat the air of the furnace 6 and at least one turbine 8 that is designed to mix the air (hot) in such a way as to make possible an optimum shaping of a shrink-wrap around each batch of products 3.

The operating method according to the invention comprises at least two operating modes, namely a superficial standby mode and a production mode, with these two modes differing from one another by the adjustments applied to the retraction device 1. In a general manner, the production mode is implemented when the bundler produces output whereas the superficial standby mode is implemented when the bundler is prevented from producing output. Starting the superficial standby mode makes it possible to realize energy savings.

Thus, during the production mode, the turbines 8, the cooling means 10, 11, have specific operating parameters, and the air of the furnace is at its setpoint temperature in production mode. In superficial standby mode, at least one of these parameters is modified, namely the speed of rotation of at least one turbine 8 of the furnace 6, preferably of all of the turbines 8. Thus, in superficial standby mode, the turbines 8 operate at a reduced speed compared to production mode. In addition, in superficial standby mode:

At least one, and even all, of the first cooling means 10 can be turned off;

At least one, and even all, of the second cooling means 11 can be turned off; and The setpoint temperature of the furnace 6 can be lowered.

The superficial standby mode can also comprise the closing of the intake and outlet doors 18 of the furnace 6, when it is equipped with such doors.

Preferably, during the superficial standby mode, each of the turbines 8 operates at reduced speed and each of the first and second cooling means 10, 11 is turned off. During the engagement of the superficial standby mode, these modifications are performed essentially simultaneously. With these elements being instantaneously or nearly instantaneously modifiable, during the return to production mode, these adjustments are brought back into production mode, essentially simultaneously, and preferably at the latest when the element that was keeping the bundler 2 from producing output is terminated and products 3 arrive at the bundler 2, ready to be processed. More preferably, these adjustments are brought back into production mode at the time when the products 3 are again found at the bundler 2, ready to be processed.

According to certain embodiments, the superficial standby mode also comprises the lowering of the setpoint temperature of the furnace 6. In contrast to the other parameters that are described above, there is a certain offset between the time when the setpoint temperature is lowered and the time when the furnace 6 effectively reaches the setpoint temperature. For this reason, this parameter is preferably modified in superficial standby mode if a minimum stopping period of the bundler 2 is known. Then, in this case, since the speeds at which a furnace drops and rises in temperature are part of the known characteristics of a furnace, it is possible to set a setpoint temperature of the furnace 6 in standby mode in such a way that the furnace 6 has the time to reach its production temperature again at the latest when the products 3 again arrive at the bundler 2, ready to be bundled. Thus, the superficial standby mode advantageously does not have an impact on the production of the line.

Furthermore, so as to optimize the energy savings, when the superficial standby mode also comprises the lowering of the setpoint temperature of the furnace 6, bringing various adjustments back into production mode is preferably done in the following order:

In a first step, the setpoint temperature of the furnace 6 is brought back to the production setpoint. This is preferably carried out early enough so that the furnace 6 reaches its setpoint temperature at the latest when products 3 are again arranged to be bundled;

In a second step, the turbines 8 are brought back to their production speed, and the cooling units 10, 11 are restarted. This is preferably carried out at the last moment, when the bundler starts up again.

In certain embodiments, the operating method also comprises an extended standby mode. This extended standby mode can be implemented when:

The superficial standby mode comprises the lowering of the setpoint temperature of the furnace 6; and When the lowering value of the setpoint temperature is large enough so that, during the drop in temperature of the furnace 6, it passes below a certain temperature called a threshold temperature that is in general around 100° C.

The retraction device 1 is then adjusted to switch, in particular automatically, from the superficial standby mode to the extended standby mode when the furnace 6 drops in temperature and it reaches the threshold temperature. The extended standby mode comprises turning off all of the turbines 8 and optionally slowing down the speed of the transport unit 9, and even stopping it.

In practice, the implementation of the extended standby mode benefits from the fact that when the furnace 6 goes below a certain temperature, it is no longer necessary to cool the heating blocks 7 and optionally the transport unit 9. Actually, when the temperature within the furnace 6 drops in temperature until the threshold temperature is reached, the heating blocks 7 are stopped from a certain time and the transport unit no longer stores much heat during its passage in the furnace 6.

When the furnace 6 then reaches its setpoint temperature in standby mode (which is lower than the threshold temperature), it should not go below this temperature. It is therefore necessary to heat the furnace 6 again, at least to keep the furnace 6 at its setpoint temperature in standby mode. The retraction device 1 is therefore programmed to switch again into superficial standby mode at that point by beginning to start up the turbines 8 again, at their operating speed in superficial standby mode. If the transport unit 9 had been stopped in extended standby mode, it is preferably restarted at this time.

Once the turbines 8 are operating, the heating blocks 7 are turned on to keep the furnace 6 at its setpoint temperature in standby mode or to reach the operating setpoint in production mode if a return to production mode is desired at this time.

In the embodiment that is illustrated in the accompanying FIG. 2, the management of the operating modes of a retraction device 1 is shown. Thus, as specified below, the device 1 comprises a control unit 15 that can make said device 1 operate in the desired mode (production mode, superficial standby mode, or optionally extended standby mode). The control unit 15 can then comprise a memory 16 and a processor 17. The memory 16 can store an instruction code that can be read and executed by the processor 17.

So as to engage the desired operating mode, the control unit 15 can be connected to all of the elements of the retraction device 1 that can be modulated during the operation of the device 1 so as to be able to control these elements. Thus, the control unit can be connected to the heating units 7, the air circulation units 8, the transport unit 9, the first and second cooling units 10, 11, and, if necessary, to the doors 18 that are arranged at the intake and the outlet of the furnace 6.

Owing to the invention, it thus is possible to save energy in a significant manner within a production and packaging line when the retraction device 1 is not operating, via the switching from production mode to superficial standby mode, and then optionally to extended standby mode. This energy savings is based both on a direct reduction of consumption via slowing down, and even the turning off of certain elements, and on indirect savings via a better preservation of heat making it possible for the retraction device 1 to consume less energy to return to production mode. In addition, the solution that is developed in this invention also has the advantage of having little, and even no, influence on the production of the entire line, in particular in terms of flow rate. Actually, at the end of a standby phase, the return to production mode is anticipated so that the retraction device 1 can preferably operate as soon as the products 3 are again ready to be bundled.

Although the description above is based on particular embodiments, it is in no way limiting of the scope of the invention, and modifications can be provided, in particular by substituting technical equivalents or by a different combination of all or part of the characteristics that are developed above.

The invention claimed is:

1. Method for operating a retraction device (1) of an automatic bundler (2) that is designed to be used in a facility for processing products (3) that are delivered as bundles (4) that each group multiple products (3) held together with a retractable film (5);

the retraction device (1) being equipped with a retraction furnace (6) comprising at least one heating unit (7) that is designed to heat air of the retraction furnace (6) and at least one air circulation unit (8) that is designed to distribute heated air in the furnace (6);

the method comprising a production mode configured to produce output of bundles (4) and a superficial standby mode configured to save energy during a temporary production stop;

wherein the superficial standby mode reduces a speed of at least one air circulation unit (8) as compared to production mode, to a non-zero value, the superficial standby mode lowers a setpoint temperature of the furnace (6) by a predefined value relative to the production mode to a set value in standby mode, the set value in standby mode being calculated so that the furnace drops in temperature to reach the lowered setpoint temperature and then rises in temperature to reach an operating temperature of the production mode upon expiration of a known minimum stop time, the known minimum stopping time being a period of time from a beginning of the superficial standby mode to when the products (3) are again ready to be processed by the bundler (2).

2. Method according to claim 1, wherein the superficial standby mode also comprises lowering a setpoint temperature of the furnace (6) by a predefined value, compared to production mode, to a target value in standby mode.

3. Method according to claim 2, further comprising an extended standby mode that comprises stopping of all air circulation units (8), with said extended standby mode being engaged automatically when, during the superficial standby mode, the setpoint temperature of the furnace (6) is lowered to reach a predefined threshold temperature.

4. Method according to claim 3, wherein the retraction device (1) returns to superficial standby mode from extended standby mode when the furnace (6) reaches the setpoint temperature of the furnace (6).

5. Method according to claim 2, wherein the retraction device (1) also comprises a transport unit (9) on which the products (3) rest and which travels through the furnace (6), at least one first cooling unit (10) that is designed to cool the transport unit (9) during a return trip, and at least one second cooling unit (11) that is designed to cool the bundles (4) at an outlet of the retraction furnace (6); with the superficial standby mode also comprising turning off at least one first cooling unit (10) and/or at least one second cooling unit (11).

6. Method according to claim 2, further comprising an extended standby mode that comprises stopping of all air circulation units (8) and the transport unit (9), with said extended standby mode being engaged when, during the superficial standby mode, the setpoint temperature of the furnace (6) is lowered to reach a predefined threshold temperature.

7. Method according to claim 1, wherein the retraction device (1) also comprises a transport unit (9) on which the products (3) rest and which travels through the furnace (6), at least one first cooling unit (10) that is designed to cool the transport unit (9) during a return trip, and at least one second cooling unit (11) that is designed to cool the bundles (4) at an outlet of the retraction furnace (6);

with the superficial standby mode also comprising turning off at least one first cooling unit (10) and/or at least one second cooling unit (11).

8. Method according to claim 7, wherein reduction in the speed of at least one air circulation unit (8) in the superficial standby mode is performed simultaneously to the turning off of at least one first cooling unit (10) and/or at least one second cooling unit (11).

9. Method according to claim 7, wherein during the superficial standby mode, the speed of all air circulation units (8) is reduced to a non-zero value, and:

A setpoint temperature of the furnace (6) is lowered by a predefined value compared to production mode, and All of the first cooling units (10) and second cooling units (11) are turned off.

10. Method according to claim 7, wherein the retraction device (1) returns to production mode from superficial standby mode, via at least the following successive steps:

(i) Bringing the setpoint temperature of the furnace (6) back to its value in production mode, (ii) Bringing the speed of all air circulation units (8) back to an operating speed thereof in production mode, and, restarting the first and/or second cooling units (10, 11).

11. Method according to claim 10, wherein step (ii) takes place once the furnace (6) has reached an operating temperature in production mode.

12. Method according to claim 7, wherein during a return to production mode from superficial standby mode, all air circulation units (8) are brought back to an operating speed thereof in production mode, and, all of the first and second cooling units (10, 11) are restarted, with this (these) action(s) being carried out no later than when the bundler (2) is to process the products (3).

13. Method according to claim 1, wherein during the superficial standby mode, the speed of at least one air circulation unit (8) is reduced to a value that ranges from 10 to 90% of the speed in production mode.

14. Method according to claim 1, wherein the setpoint temperature of the furnace (6) is lowered by a predefined value, compared to production mode, to a target value in standby mode, with said lowering of the setpoint temperature being performed simultaneously to reduction in the speed of at least one air circulation unit (8).

15. Method according to claim 1, wherein during the superficial standby mode, the speed of at least one air circulation unit (8) is reduced to a value that ranges from 30 to 80% of the speed in production mode.

16. Method according to claim 1, wherein during the superficial standby mode, the speed of at least one air circulation unit (8) is reduced to a value that ranges from 50 to 70% of the speed in production mode.

17. Method according to claim 1, wherein during a return to production mode from superficial standby mode, the setpoint temperature of the furnace (6) is brought back to an operating temperature in production mode making it possible for the furnace (6) to be at the operating temperature when the bundler (2) is to process the products (3).

* * * * *